United States Patent [19]

Fujiwara

[11] 4,110,065

[45] Aug. 29, 1978

[54] COCK APPARATUS OF AUTOMATIC IGNITION TYPE FOR GAS APPLIANCE

[75] Inventor: Yasuo Fujiwara, Yokohama, Japan

[73] Assignee: Aero-Spec Products Co., Ltd., Tokyo, Japan

[21] Appl. No.: 797,645

[22] Filed: May 16, 1977

[30] Foreign Application Priority Data

Jul. 25, 1976 [JP] Japan ..... 51-102131

[51] Int. Cl.[2] ..... F23Q 7/12

[52] U.S. Cl. ..... 431/255; 126/39 E; 431/47

[58] Field of Search ..... 431/254, 255, 256, 257, 431/47, 43; 126/39 E, 42

[56] References Cited

U.S. PATENT DOCUMENTS

| | | | |
|---|---|---|---|
| 2,249,090 | 7/1941 | Rabinowicz | 431/254 X |
| 2,288,208 | 6/1942 | Rabinowicz | 431/254 X |
| 3,676,041 | 7/1972 | Mobus | 431/255 X |
| 3,676,047 | 7/1972 | Soma | 431/255 |
| 3,770,363 | 11/1973 | Freedrich | 431/47 |

FOREIGN PATENT DOCUMENTS

| | | | |
|---|---|---|---|
| 2,250,964 | 10/1972 | Fed. Rep. of Germany | 431/254 |
| 2,312,920 | 3/1973 | Fed. Rep. of Germany | 431/254 |

*Primary Examiner*—Edward G. Favors

*Attorney, Agent, or Firm*—Pollock, Vande Sande & Priddy

[57] ABSTRACT

A cock apparatus of automatic ignition type for use in a gas appliance including an ignition handle, a valve member disposed within the cock body for rotation with the turning movement of the ignition handle thereby supplying gas to a main burner and a pilot burner, and a spark generator generating sparks for igniting the pilot burner in response to the turning movement of the ignition handle. The cock comprises a rotary shaft capable of free rotation and restrained rotation relative to the valve member and normally urged by a spring to rotate in the closing direction of the valve member, and a heat sensor for sensing ignition and non-ignition of the main burner, the heat sensor being operatively connected to the rotary shaft so that the rotary shaft and the valve member can be automatically rotated in the valve closing direction by the force of the spring in the event of ignition failure of gas or accidental extinction of gas flame burning on the main burner.

9 Claims, 9 Drawing Figures

COCK APPARATUS OF AUTOMATIC IGNITION TYPE FOR GAS APPLIANCE

BACKGROUND OF THE INVENTION

This invention relates to cock apparatus of automatic ignition type for use in combustible gas appliances, and more particularly to a cock apparatus of the above type provided with a safety device which prevents leakage of live or fresh combustible gas.

Commercially available, conventional cock apparatus of automatic ignition type used heretofore in gas appliances are not provided with a safety device which prevents leakage of live or fresh combustible gas. In a gas appliance using such a conventional cock apparatus, therefore, live or fresh gas will be discharged from the gas appliance when the gas flame goes out due to, for example, the wind, overflow of liquid from a pot containing food being cooked, or inadvertent depression of the gas hose by the foot of somebody, and no one is aware of extinction of the gas flame. Continuation of such a situation is very dangerous in that the persons in the house or building may be poisoned by the gas or the discharged live gas may catch fire by being triggered by a spark or the like resulting in gas explosion or fire. Actually, according to yearly statistics, many fatal accidents owing to live gas discharge are reported, and the percentage of such fatal accidents is extremely high in the case of LP gas to the smell of which the nose is less sensitive than city gas.

SUMMARY OF THE INVENTION

With a view to obviate such fatal accidents, it is a primary object of the present invention to provide a cock apparatus of automatic ignition type which is provided with a live or fresh combustible leakage preventive device and can thus be more reliably and safely used in a gas appliance than heretofore.

The cock apparatus of automatic ignition type according to the present invention which attains the above object comprises a rotary shaft capable of free rotation and restrained rotation relative to a valve member and normally urged by a spring to rotate in the closing direction of the valve member, and a heat sensor for sensing ignition and non-ignition of a main burner, the heat sensor being operatively connected to the rotary shaft so that the rotary shaft and the valve member can be automatically rotated in the valve closing direction by the force of the spring in the event of ignition failure of gas or accidental extinction of gas flame burning on the main burner.

DETAILED DESCRIPTION OF THE INVENTION

For a better understanding of the present invention, a cock structure of automatic ignition type commonly used heretofore in gas appliances will be described with reference to FIGS. 1 to 3 before describing the present invention in detail.

Figure 1:
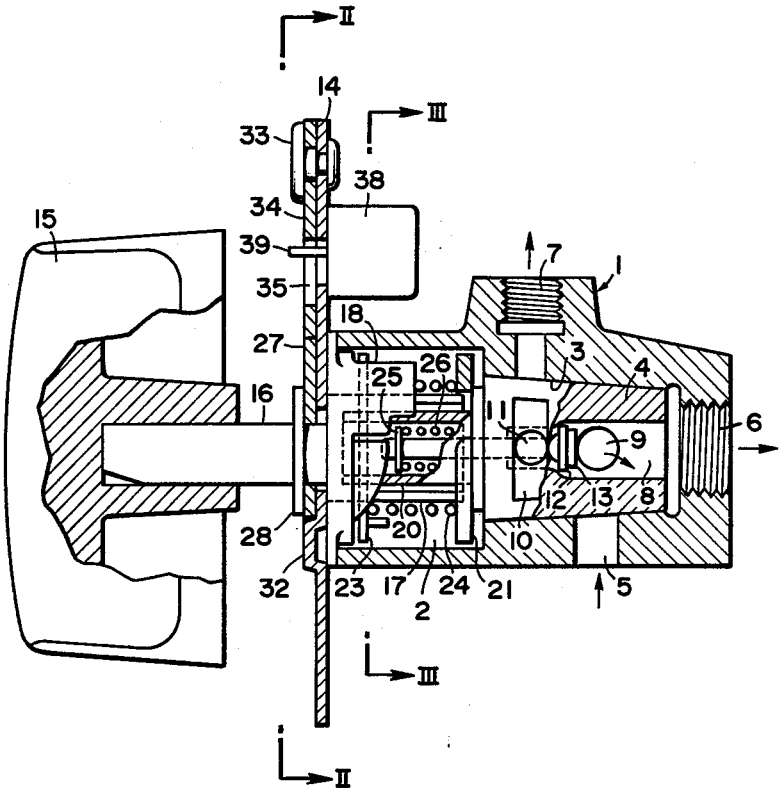
FIG. 1 PRIOR ART
FIG. 1 is a longitudinally sectional, side elevational view of one form of conventional cocks of automatic ignition type.

Referring to FIG. 1, the cock body designated generally by numeral 1 is generally cylindrical and is formed with a recess 2 at one end thereof. Another recess 3 of frusto-conical shape is formed as a continuation of the bottom of the recess 2, and a valve member 4, which is similarly frusto-conical, is disposed rotatably within this recess 3. A gas intake port 5 extends radially through the peripheral wall of the cock body 1 to communicate with the frusto-conical recess 3, and from this recess 3, a gas supply port 6 extends longitudinally or axially through the end wall of the cock body 1. Also, from the recess 3, a pilot gas supply port 7 extends radially through the peripheral wall of the cock body 1. Both these supply ports 6 and 7 are threaded as shown.

A central axial bore or passage 8 is provided in the valve member 4 to disconnectably connect the gas intake port 5 with the gas supply port 6, and a transverse bore or passage 9 communicating with the central axial passage 8 extends through the peripheral wall of the valve member 4. Therefore, gas is supplied to the gas supply port 6 when the valve member 4 is rotated to provide communication of the transverse passage 9 with the gas intake port 5. A cavity 10 is formed as a continuation of the central axial passage 8 in the valve member 4, and a transverse bore or passage 11 communicating with this cavity 10 extends through the peripheral wall of the valve member 4 to disconnectably connect the gas intake port 5 with the pilot gas supply port 7. Therefore, gas is supplied to the pilot gas supply port 7 when the valve member 4 is rotated to provide communication between the gas intake port 5 and the pilot gas supply port 7. The cavity 10 is provided so that gas can be supplied to the pilot gas supply port 7 before it is supplied to the gas supply port 6 in response to the rotation of the valve member 4 toward the gas supply position. A tapered stepped portion 12 is formed between the transverse passages 9 and 11 communicating with the central axial passage 8, and a pilot valve member 13 described later is in seating engagement with this stepped portion 12.

The cock body 1 is mounted on a frame member 14, and a shaft 16 of an ignition handle 15 extends through this frame member 14 into the recess 2 of the cock body 1. This shaft 16 has a sleeve 17 and a cam 18 located within the recess 2 of the cock body 1, and a diametrally opposite pair of grooves 19 are formed on this sleeve 17 as shown in FIG. 3. The valve member 4 is also provided with a sleeve 20 and a collar 21 located within the recess 2 of the cock body 1. This sleeve 20 is received loosely within the aforesaid sleeve 17 and is also formed with a diametrally opposite pair of grooves 22 as shown in FIG. 3. The grooves 19 in the sleeve 17 register with the grooves 22 in the sleeve 20, and a pin 23 is loosely received in these grooves 19 and 22. Therefore, rotation of the shaft 16, hence rotation of the sleeve 17 due to turning of the ignition handle 15 causes rotation of the pin 23 around the axis of the shaft 16, thereby causing rotation of the valve member 4 around its own axis.

The pin 23 is engaged by the cam surface of the cam 18 to be normally restrained from movement toward the frame member 14, and the valve member 4 is normally urged toward the gas supply port 6 by a compression coil spring 24 interposed between the pin 23 and the collar 21. The pilot valve member 13 has an end extension extending into the sleeve 20, and a compression coil spring 26 is interposed between a push nut 25 fixed to that end portion of the pilot valve member 13 in the sleeve 20 and the base portion of the sleeve 20 to normally urge the pilot valve member 13 into pressure engagement with the stepped portion 12. When the ignition handle 15 is turned in the igniting direction, the pin 23 engaged by the cam 18 is moved toward the pilot valve member 13 along the cam surface of the cam 18 until finally it is pressed against the end face of the pilot valve member 13 to release the pilot valve member 13 from the seating engagement with the stepped portion 12.

A wheel 27 is fixedly mounted on the shaft 16 by an E-shaped snap ring 28 at a position closely adjacent to the frame member 14. As best shown in FIG. 2, this wheel 27 is partly toothed at a portion 29 and has a reduced diameter portion 31 defined between a pair of circumferentially spaced stepped portions 30. A projecting portion 32 of the frame member 14 is located to engage with this reduced diameter portion 31 of the wheel 27 so that the wheel 27 and the shaft 16 may not be rotated beyond an angle of 110°. An arm 34 is rockably pivoted to the frame member 14 by a rivet 33 and has a toothed portion 34*a* which meshes with the toothed portion 29 of the wheel 27. This arm 34 is provided with a slot 35 consisting of an arcuate slot portion 36 and a straight slot portion 37 extending inwardly from one end of the arcuate slot portion 36. A knob 39 of a spark generator 38 mounted on the back face of the frame member 14 extends into the slot portion 37 of the slot 35. This knob 39 extends through an aperture 40 formed in the frame member 14, and this aperture 40 has a linear guide edge 41 which engages with the knob 39 to guide the same along a linear path during part of the rocking movement of the arm 34. The handle 15 can be turned through a maximum angle of 110° at which it is restricted from further turning movement by being stopped by the projecting portion 32 of the frame member 14, although turning of the handle 15 to an angular position of 90° provides maximum gas supply. Thus, a spring 42 is mounted on the frame member 14 for returning the handle 15 to the angular position of 90°.

Fatal accidents due to discharge of live or fresh combustible gas as described hereinbefore have occurred frequently in such a prior art cock apparatus of automatic ignition type, since it is not provided with a device for preventing leakage of live or fresh combustible gas. With a view to reliably prevent such fatal accidents due to discharge of live gas, the present invention contemplates the provision of a cock apparatus of automatic ignition type equipped with a novel device for preventing objectionable leakage of live or fresh combustible gas.

Figure 2:
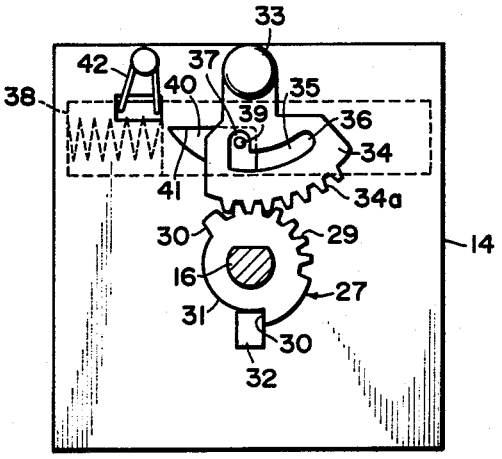
FIG. 2 PRIOR ART
FIG. 2 is a front elevational view taken along the line II—II in FIG. 1 to show the arrangement of associated parts.
Figure 3:
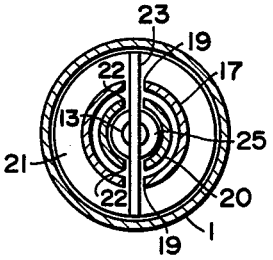
FIG. 3 PRIOR ART
FIG. 3 is a sectional view taken along the line III—III in FIG. 1 to show the arrangement of associated parts.

Preferred embodiments of the present invention will now be described with reference to FIGS. 4 to 9 in which like reference numerals are used throughout to designate like parts appearing in FIGS. 1 to 3 illustrating the structure of the prior art cock of automatic ignition type, and since these parts in the present invention are similar to the prior art ones, any detailed description is unnecessary.

FIGS. 4 to 7 show a first embodiment of the present invention which employs a heat sensor 50 of mercury and diaphragm type.

Figure 4:
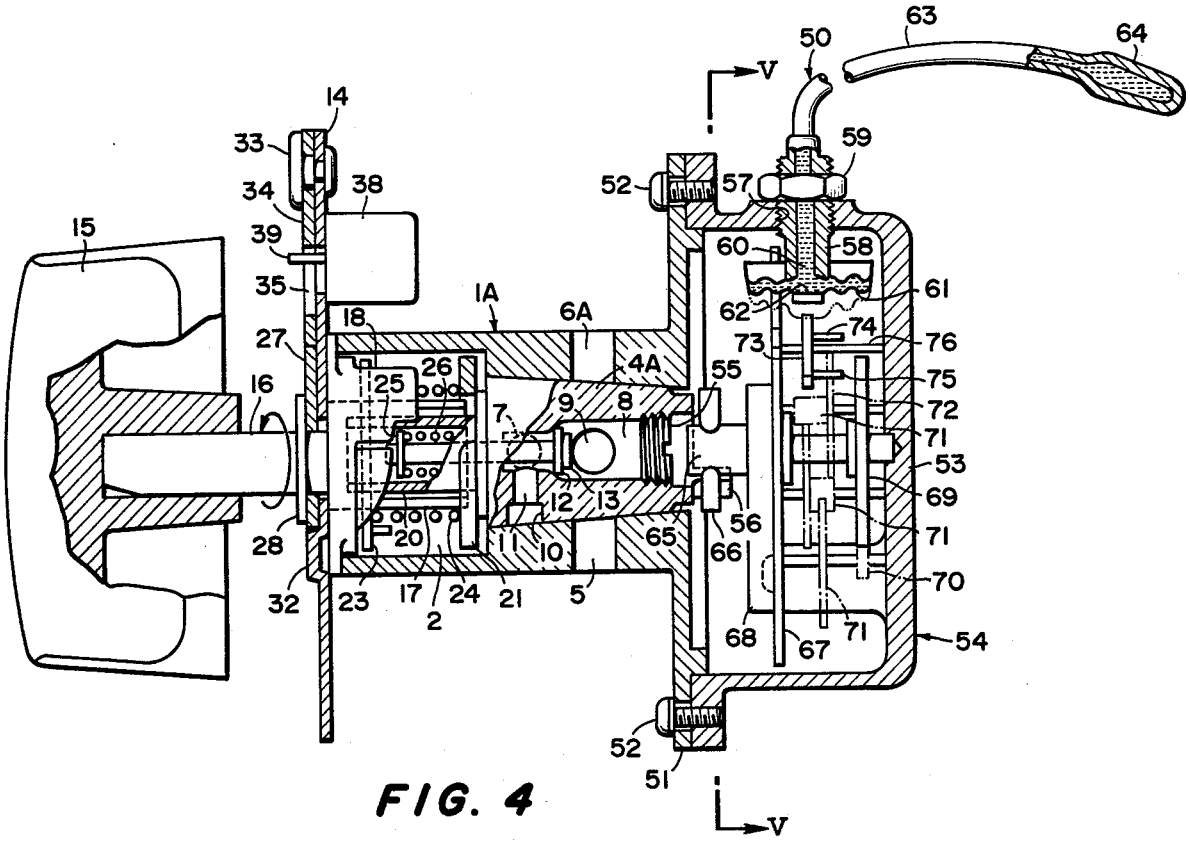
FIG. 4 is a longitudinally sectional, side elevational view of a first embodiment of the cock of automatic ignition type according to the present invention.

Referring to FIG. 4, a flange 51 is provided at the front end of a cock body 1A, and a device 54 for preventing accidental leakage of live or fresh combustible gas is housed within a casing 53 fixed to the flange 51 by bolts 52. In the present invention, a gas supply port 6A is formed in the cock body 1A to be located on an extension of the axis of a gas intake port 5 in view of the above location of the gas leakage preventive device 54. A central axial passage 8 formed in a valve member 4A is threaded at a portion adjacent to the gas leakage preventive device 54, and an externally threaded plug 55 is in threaded engagement with this threaded portion of the central axial passage 8. A pair of diametrally opposite lugs 56 are provided as an integral part of the front end of the valve member 4A.

The heat sensor 50 has a hollow base portion 58 threaded to be screwed into a threaded hole 57 formed in the peripheral wall of the casing 53, and this base portion 58 is secured to the casing 53 by a nut 59. The extending length of the base portion 58 of the heat sensor 50 in the internal space of the casing 53 can be adjusted as desired due to the threaded engagement of the base portion 58 with the threaded hole 57. A central axial passage 60 extends through the base portion 58, and a diaphragm 61 having a central abutment 62 is mounted on the inner end of the hollow base portion 58. A tube 63 is connected at one end thereof to the outer end of the hollow base portion 58, and a heat sensing portion 64 having an internal space is connected to the other end of the tube 63. This heat sensing portion 64 is made of a heat-resisting alloy since it is exposed directly to the flame of burning gas. Mercury is filled in the closed space formed by the central axial passage 60 of the base portion 58, the diaphragm 61, the tube 63 and the internal space of the heat sensing portion 64.

A rotary shaft 65 is disposed within the casing 53 in axially aligned relation with the extension of the axis of the valve member 4A, and a pin 66 is fixed to the rear end of the rotary shaft 65 and protrudes on opposite sides of the rotary shaft 65 to extend between the lugs 56 provided on the front end of the valve member 4A. The pin 66 engages with the lugs 56 in the full closed position of the cock. The rotary shaft 65 is rotatably journaled in the front end wall of the casing 53 and a supporting plate 67 disposed in the middle area of the internal space of the casing 53. A spiral spring 68 is anchored at one or inner end thereof to an intermediate portion of the rotary shaft 65 and at the other or outer end thereof to a suitable portion of the supporting plate 67 so as to normally bias the rotary shaft 65 clockwise in FIG. 5.

Figure 5:
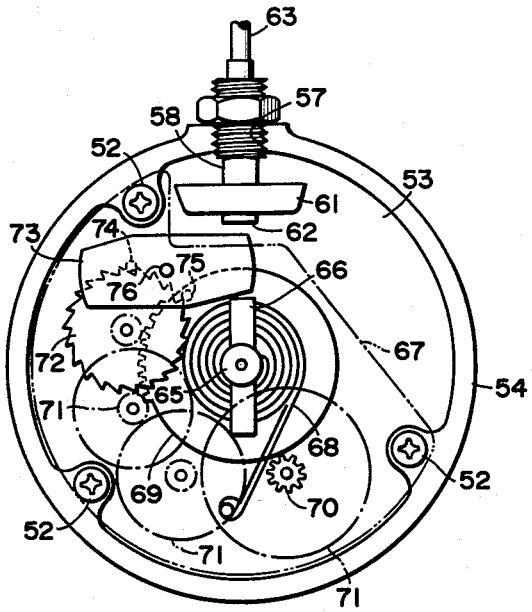
FIG. 5 is a front elevational view taken along the line V—V in FIG. 4 to show the arrangement of associated parts.

Referring to FIGS. 4 and 5, a partly toothed wheel 69 is fixedly mounted on the rotary shaft 65 adjacent to the front end and is adapted for making meshing engagement with a pinion 70 mounted in the casing 53. The relation between the partly toothed wheel 69 and the pinion 70 is such that they do not mesh with each other when the valve member 4A is in its full closed position, and they start to mesh with each other when an ignition handle 15 is turned to an angular position of 90° which provides the full open position of the valve member 4A. The pinion 70 is connected finally to an escapement wheel 72 through a gear train consisting of a plurality of gears 71 so that the partly toothed wheel 69 brought into meshing engagement with the pinion 70 can be returned to the original position at a constant speed by the force of the spiral spring 68. A rocking arm 73 is disposed adjacent to the escapement wheel 72, and a pair of pins 74 and 75 are fixed to the rocking arm 73 at positions engageable alternately with the teeth of the escapement wheel 72. One end of the rocking arm 73 is disposed directly beneath the abutment 62 of the diaphragm 61, and in the retracted position of the abutment 62, such end of the rocking arm 73 is spaced from the abutment 62 by a distance of about 0.1 mm. The rocking arm 73 is pivoted to the casing 63 by a pivot pin 76 so that rocking movement of the rocking arm 73 around the pivot pin 76 permits rotation of the escapement wheel 72 at a constant speed by the action of the pins 74 and 75 engaging alternately with the successive teeth of the escapement wheel 72.

The operation of the first embodiment of the present invention will be described with reference to FIGS. 4 to 7 and also with reference to FIG. 2.

In response to the turning of the ignition handle 15 in a direction as shown by the arrow in FIG. 4 or counterclockwise, the wheel 27 is also rotated to start to rotate the valve member 4A counterclockwise in FIG. 4 through the pin 23. The rotation of the wheel 27 causes clockwise rocking movement of the arm 34 in meshing engagement therewith in FIG. 2, and the knob 39 of the spark generator 38 located in the slot portion 37 of the slot 35 in the arm 34 is also urged clockwise in FIG. 2. Due to the fact that the lugs 56 of the valve member 4A are engaged by the pin 66 of the rotary shaft 65 in the full closed position of the valve member 4A, the rotary shaft 65 and the partly toothed wheel 69 are rotated counterclockwise in FIG. 5. When the turning angle of the ignition handle 15 is increased to reach a predetermined angle, the transverse passage 9 of the valve member 4A registers with the gas intake port 5 of the cock body 1A, and gas is now admitted into the central axial passage 8 of the valve member 4A from the gas intake port 5. The pilot valve member 13 is urged to the open position by the action of the cam 18, and gas is admitted into a pilot burner (not shown) through the pilot gas supply port 7.

Figure 6:
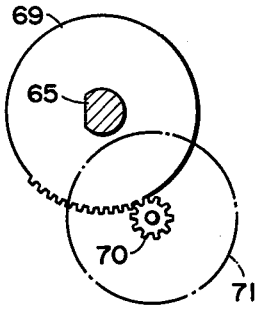
FIG. 6 illustrates the relation between the partly toothed wheel and the pinion in FIG. 5.

With further turning movement of the ignition handle 15 counterclockwise in FIG. 5 to bring the same in an angular position of 90°, the partly toothed wheel 69 starts to mesh with the pinion 70 as shown in FIG. 6. With further turning movement of the ignition handle 15, the knob 39 of the spark generator 38 is disengaged from the slot portion 37 by being engaged by the guide edge 41 of the aperture 40 in the frame member 14 and is guided along the arcuate slot portion 36 at a high speed to permit ignition of the pilot burner by the spark generator 38. A main burner (not shown) is then ignited by the pilot flame of burning gas on the pilot burner.

Immediately before the ignition handle 15 is turned to its maximum angular position of 110°, the pin 23 engages with a concave cam surface portion of the cam 18, with the result that the pilot valve member 13 is quickly restored to the original position by the force of the coil spring 26. Thus, the pilot valve member 13 makes seating engagement with the stepped portion 12 to close the pilot gas passage to shut off the supply of gas into the pilot gas port 7. At this time, gas is continuously supplied to the main burner.

Figure 7:
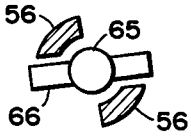
FIG. 7 illustrates the relation between the lugs on the valve member and the pin on the rotary shaft in FIG. 4.

When the turning force imparted to the ignition handle 15 is released upon attainment of the maximum angular position of the handle 15, the elements including the valve member 4A and arm 34 are returned to the angular position of 90° by the force of the spring 42. The aforementioned operation is the same as that of the prior art cock of automatic ignition type. When the valve member 4A is returned to the above angular position, the lugs 56 of the valve member 4A are angularly spaced apart from the pin 66 of the rotary shaft 65 by an angle of about 20°. However, due to the fact that the force of the spiral spring 68 acts upon the rotary shaft 65, the rotary shaft 65, hence the pin 66 starts to rotate clockwise in FIG. 5 at a low speed to follow up the lugs 56 of the valve member 4A. In about 15 to 18 seconds thereafter, mercury filled within the heat sensing portion 64 of the heat sensor 50 exposed directly to the flame of burning gas on the main burner expands to deform the diaphragm 61 into a shape as shown by the phantom lines in FIG. 4. As a result, the abutment 62 is pressed against the confronting end of the rocking arm 73 to restrain the rocking arm 73 from rocking movement. Due to the restraint of rocking movement of the rocking arm 73, the rotary shaft 65 and its pin 66 are held stationary at an angular position of about 95° relative to the full closed position. Therefore, the pin 66 is now angularly spaced apart from the lugs 56 of the valve member 4A by angle of about 5° as shown in FIG. 7. At this time, the valve member 4A and the rotary shaft 65 are independent of each other. The amount of gas supplied through the gas supply port 6A can thus be controlled to control the condition of flame of gas burning on the main burner by suitably turning the ignition handle 15 in the closing direction.

In the event that gas is supplied to the main burner without igniting the same, the diaphragm 61 remains in the solid line position in FIG. 4, and the rocking arm 73 can make free rocking movement. In such a case, therefore, the partly toothed gear 69 continues to rotate clockwise in FIG. 5 by the action of the spiral spring 68 until finally it is returned to the angular position of 90° at which it is released from the meshing engagement with the pinion 70. The partly toothed wheel 69 is then quickly rotated clockwise by the force of the spiral spring 68, and the pin 66 of the rotary shaft 65 engages with the lugs 56 of the valve member 4A to restore the valve member 4A to the full closed position. This automatic restoration of the valve member 4A to the full closed position requires only about 20 to 23 seconds after the valve opening manipulation.

Suppose then the case in which the flame of gas burning on the main burner goes out due to some unusual situation after the main burner has been ignited. In such a case, the volume of mercury contained in the heat sensor 50 decreases with the lowering of the temperature, and the diaphragm 61 retakes the shape shown by the solid lines in FIG. 4. Thereupon, the valve member 4A is automatically restored to the full closed position in a manner as described with reference to the aforementioned case of unsuccessful ignition. In this specific case, a length of time of about 10 to 15 seconds is required until the partly toothed wheel 69 starts to rotate in response to the accidental extinction of the flame, and a length of time of about 5 to 10 seconds is required until the valve member 4A is then restored automatically to the full closed position, which totals about 15 to 25 seconds.

Figure 8:
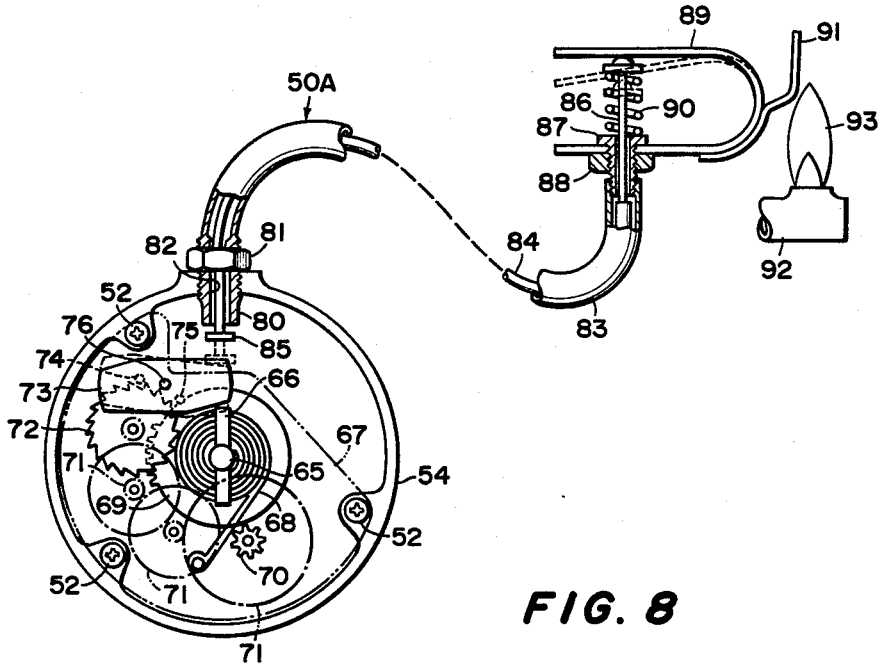
FIGS. 8 and 9 are longitudinally sectional, side elevational views of a second and a third embodiment respectively of the cock of automatic ignition type according to the present invention.

FIG. 8 shows a second embodiment of the present invention which employs a heat sensor of bimetal type. In FIG. 8, the same reference numerals are used to designate the same parts appearing in FIGS. 4 to 7, and any detailed description of these parts is unnecessary.

Referring to FIG. 8, a heat sensor 50A is screwed at its base portion 80 into a corresponding threaded hole of the casing 53 and is adjustably fixed in position by a nut 81. A central axial passage 82 extends through this base portion 80. A tube 83 is connected at one end thereof to the outer end of the base portion 80, and a flexible shaft 84 is slidably received within the tube 83 and the central axial passage 82 of the base portion 80. This flexible shaft 84 is provided with an abutment 85 at the end extending into the internal space of the casing 53, so that the abutment 85 can be pressed against the associated end of the rocking arm 73 when advanced. A rod 86 of heat-resisting ceramic material is connected to the other end of the flexible shaft 84, and a generally U-shaped bimetal element 89 is mounted on the other end of the tube 83 by means of a fixture 87 and a nut 88. The upper arm of the U-shaped bimetal element 89 is spaced slightly from the upper or free end of the ceramic rod 86. A coil spring 90 is interposed between the upper arm of the bimetal element 89 and the fixture 87 so as to normally urge the ceramic rod 86 toward the upper arm of the bimetal element 89. A strip 91 of heat conductor is fixed to the bimetal element 89 to be directly exposed to the flame 93 of gas burning on the main burner 92.

Therefore, when the main burner 92 is properly ignited, the bimetal element 89 is deformed as shown by the broken lines in FIG. 8, and the ceramic rod 86 is urged to advance the abutment 85 toward the associated end of the rocking arm 73. The rocking arm 73 is restrained from rocking movement by the abutment 85, thereby causing the return movement of the partly toothed wheel 69. However, the partly toothed wheel 69 is merely rotated to return to the angular position of about 95° without regard to the position of the valve member 4A, as described with reference to the first embodiment. In the event that the main burner 92 is not ignited or the flame of gas burning on the main burner 92 goes out, the bimetal element 89 remains in the solid line position, and the ceramic rod 86 is pulled upward by the force of the coil spring 90. Thus, in such an event, the abutment 85 does not restrain the rocking movement of the rocking arm 73, and the valve member 4A is automatically restored to the full closed position by the force of the spiral spring 68.

Figure 9:
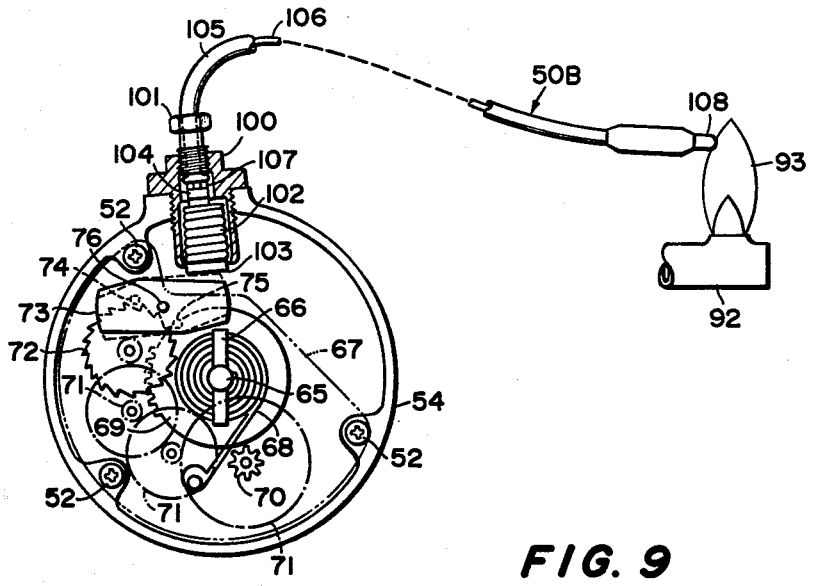

FIG. 9 shows a third embodiment of the present invention which employs a heat sensor of thermocouple type. In FIG. 9 too, the same reference numerals are used to designate the same parts appearing in FIGS. 4 to 7.

Referring to FIG. 9, a heat sensor or thermocouple unit 50B is screwed at its base portion into a threaded hole of a fixture 100 and is adjustably fixed in position by a nut 101. The fixture 100 is screwed into a threaded hole of the casing 53, and a coil 102 having an associated armature 103 is disposed within the fixture 100. The armature 103 protrudes slightly at its lower end into the internal space of the casing 53 to be disposed opposite to the associated end of the rocking arm 73. The coil 102 is connected at one end thereof to the fixture 100 and at the other end thereof to a terminal 104. The terminal 104 is connected to one end of a lead wire 106 received in a lead pipe 105, and a washer 107 of electrical insulator is interposed between the lead pipe 105 and the lead wire 106. A heat sensing portion or thermocouple element 108 is connected to the free end of the lead wire 106 and lead pipe 105 to be directly exposed to the flame 93 of gas burning on the main burner 92.

An electromotive force is produced in the thermocouple element 108 by the heat of the flame 93, and the coil 102 is energized to attract the rocking arm 73 toward the armature 103 thereby restraining the rocking arm 73 from rocking movement. In the event that the flame 93 goes out, the temperature of the heat sensing portion 108 is reduced, and the electromotive force disappears, with the result that the coil 102 is not energized, and the rocking arm 73 is free to make rocking movement.

It will be understood from the foregoing detailed description that the cock of automatic ignition type according to the present invention comprises a rotary shaft capable of free rotation and restrained rotation relative to a valve member and normally urged by a spring to rotate in the closing direction of the valve member, and a heat sensor for sensing ignition and non-ignition of a main burner, the heat sensor being operatively connected to the rotary shaft so that the rotary shaft and the valve member can be automatically rotated in the valve closing direction by the force of the spring in the event of ignition failure of gas or accidental extinction of gas flame burning on the main burner. The present invention is therefore advantageous in that dangerous leakage of live gas can be reliably prevented in spite of a simple construction, and the absence of a source of sparks such as a commercial ac power supply line or a battery eliminates the danger of catch-fire of leaking gas. The present invention is further advantageous in that the valve member is not maintained in the open position in the event that the gas supply is temporarily interrupted for some reason, and gas does not leak when the gas supply is re-started, due to the fact that the valve member is adapted to be automatically restored to the full closed position in response to the extinction of the flame of gas burning on the main burner.

I claim:

1. A cock apparatus of automatic ignition type for use in a gas appliance comprising:

a frame member;

a cock body mounted on one side of said frame member and having an internal space;

an ignition handle having a shaft extending at one end portion thereof into the internal space of said cock body and at the other end portion thereof toward the exterior through said frame member;

a valve member disposed within the internal space of said cock body for rotation with the turning movement of said ignition handle thereby permitting supply and shut-off of the flow of combustible gas toward a main burner and a pilot burner;

a spark generator generating sparks for igniting said pilot burner in response to the turning movement of said ignition handle; and a device affixed to said cock body for preventing leakage of live combustible gas;

said live gas leakage preventive device comprising a casing mounted on the end face of said cock body, a rotary shaft journaled in said casing and capable of free rotation and restrained rotation relative to said valve member, spring means mounted on said rotary shaft for normally urging said rotary shaft in the closing direction of said valve member, heat sensor means mounted on said casing for sensing ignition and non-ignition of said burner, engaging means for forcedly interrupting the operation of said spring means by cooperating with said heat sensor means when said main burner is properly ignited, and means for releasing said engaging means thereby permitting said spring means to exert its resilient returning force at a constant speed when said heat sensor means does not operate or ceases to operate due to ignition failure or accidental flame extinction of said main burner.

2. A cock apparatus of automatic ignition type for use in a gas appliance as claimed in claim 1, wherein said heat sensor means in said live gas leakage preventive device comprises a tubular element having one end providing a base portion fixedly but adjustably inserted into said casing and the other end providing a heat sensing portion of heat-resisting alloy disposed to be directly exposed to the flame of burning gas, and a diaphragm mounted on the lower end of said base portion to be located within said casing and having an abutment at its lower central part, the closed space formed by said tubular element and said diaphragm containing mercury therein.

3. A cock apparatus of automatic ignition type for use in a gas appliance as claimed in claim 1, wherein said heat sensor means in said live gas leakage preventive device comprises a tubular element having one end providing a base portion fixedly but adjustably inserted into said casing and the other end terminating in a mounting means, a flexible shaft disposed slidably within said tubular element and having an abutment fixed to the end protruding through said base portion of said tubular element into said casing, a generally U-shaped bimetal element partly fixedly supported by said mounting means, a strip of heat conductor being fixed to said bimetal element to be directly exposed to the flame of burning gas, and a rod of heat-resisting ceramic material disposed between one of the arms of said bimetal element and the end of said flexible shaft adjacent to said mounting means to be normally biased by a coil spring toward said arm of said bimetal element.

4. A cock apparatus of automatic ignition type for use in a gas appliance as claimed in claim 1, wherein said heat sensor means in said live gas leakage preventive device comprises a coil housing fixedly but adjustably inserted into said casing, a coil disposed within said coil housing and connected at one end thereof to said housing and at the other end thereof to a terminal, an armature fixedly received in the lower end portion of said coil to protrude slightly from said coil housing into said casing, a lead pipe fixed at one end thereof to said coil housing and having the other end thereof extending to terminate in a heat sensing portion located to be exposed directly to the flame of burning gas for producing an electromotive force therein, and a lead wire disposed within said lead pipe in electrically insulated relation to connect said terminal in said coil housing to said heat sensing portion.

5. A cock apparatus of automatic ignition type for use in a gas appliance as claimed in claim 1, wherein said spring means mounted on said rotary shaft for normally urging said rotary shaft in the closing direction of said valve member is a spiral spring.

6. A cock apparatus of automatic ignition type for use in a gas appliance as claimed in claim 1, wherein said engaging means for forcedly interrupting the operation of said spring means by cooperating with said heat sensor means when said main burner is properly ignited, comprises a rocking arm rockably pivoted to said casing and restrained from rocking movement by said heat sensor means when said main burner is properly ignited, a pair of pins protruding from said rocking arm, and an escapement wheel engaged by said pins.

7. A cock apparatus of automatic ignition type for use in a gas appliance as claimed in claim 1, wherein said means for releasing said engaging means thereby permitting said spring means to exert its resilient returning force at a constant speed, comprises a gear train meshing with a gear mounted coaxially on said rotary shaft, and the last one of said gear train meshes with a gear mounted in coaxial relation with said escapement wheel.

8. A cock apparatus of automatic ignition type for use in a gas appliance as claimed in claim 1, wherein said rotary shaft in said live gas leakage preventive device has an axis aligning with an extension of the axis of said valve member and is provided at the front end thereof with a pin diametrally extending therethrough, and said valve member is provided at the front end thereof with a pair of diametrally opposite lugs which engage with said pin to cause the rotation of said rotary shaft.

9. A cock apparatus of automatic ignition type for use in a gas appliance comprising:

a frame member;

a cock body mounted on one side of said frame member and having an internal space;

an ignition handle having a shaft extending at one end portion thereof into the internal space of said cock body and at the other end portion thereof toward the exterior through said frame member;

a valve member disposed within the internal space of said cock body for rotation with the turning movement of said ignition handle and having internal passages for supplying combustible gas toward a main burner and a pilot burner respectively, said valve member being provided at the front end thereof with a pair of lugs protruding in parallel with the axis of said valve member at diametrally opposite positions;

a spark generator generating sparks for igniting said pilot burner in response to the turning movement of said ignition handle;

a casing mounted on the end face of said cock body on the side remote from said frame member;

a rotary shaft journaled in said casing in coaxial relation with said valve member and provided at the front end confronting said valve member with a pin extending diametrally and normal to the axis thereof, said rotary shaft being capable of free rotation relative to said valve member within a predetermined angular range and also capable of restrained rotation relative to said valve member after said free rotation by the cooperation of said pin with said lugs of said valve member;

a spiral spring anchored at one end thereof to said rotary shaft and at the other end thereof to said casing for normally urging said rotary shaft in the closing direction of said valve member in which said combustible gas supply passages are closed;

heat sensor means operating by sensing ignition and non-ignition of said main burner with its heat sensing portion exposed directly to the flame of gas burning on said main burner;

a rocking arm rockably pivoted to said casing and restrained from rocking movement by said heat sensor means when said main burner is properly ignited, said rocking arm being provided with a pair of parallel pins;

an escapement wheel adapted to be locked against rotation by being engaged by alternate ones of said pins of said rocking arm; and a gear train meshing with a gear mounted coaxially on said rotary shaft, the last one of said gear train meshing with a gear mounted in coaxial relation with said escapement wheel.

* * * * *